US010347269B2

(12) United States Patent
Van Hoesel et al.

(10) Patent No.: US 10,347,269 B2
(45) Date of Patent: Jul. 9, 2019

(54) NOISE REDUCTION METHOD AND SYSTEM

(71) Applicant: HEAR IP Pty Ltd, Melbourne, Victoria (AU)

(72) Inventors: Richard Van Hoesel, Melbourne (AU); Jorge Mejia, Melbourne (AU)

(73) Assignee: HEAR IP PTY LTD, Melbourne, Victoria (AU)

( * ) Notice: Subject to any disclaimer, the term of this patent is extended or adjusted under 35 U.S.C. 154(b) by 0 days.

(21) Appl. No.: 14/771,468

(22) PCT Filed: Feb. 26, 2014

(86) PCT No.: PCT/AU2014/000178
§ 371 (c)(1),
(2) Date: Aug. 28, 2015

(87) PCT Pub. No.: WO2014/138774
PCT Pub. Date: Sep. 18, 2014

(65) Prior Publication Data

US 2016/0005417 A1 Jan. 7, 2016

(30) Foreign Application Priority Data

Mar. 12, 2013 (AU) ..... 2013900843

(51) Int. Cl.
*H04R 3/00* (2006.01)
*H04R 25/00* (2006.01)
(Continued)

(52) U.S. Cl.
CPC ..... *G10L 21/0208* (2013.01); *G10L 21/0232* (2013.01); *G10L 21/034* (2013.01);
(Continued)

(58) Field of Classification Search
CPC ..... G10L 21/0208; G10L 2021/02166; H04R 3/005; H04R 25/00
(Continued)

(56) References Cited

U.S. PATENT DOCUMENTS 4,683,449 A * 7/1987 Kato ..... H03G 9/025 330/144
8,098,844 B2 1/2012 Elko
(Continued)

FOREIGN PATENT DOCUMENTS

| | | | |
|---|---|---|---|
| EP | 2 056 296 | A2 | 5/2009 |
| JP | 2012023688 | A | 2/2012 |
| WO | 01/52242 | A1 | 7/2001 |

OTHER PUBLICATIONS

International Search Report (PCT/AU2014/000178); dated Apr. 16, 2014.

(Continued)

*Primary Examiner* — Sean H Nguyen
(74) *Attorney, Agent, or Firm* — Howard & Howard Attorneys PLLC

(57) ABSTRACT

Noise reduction methods and systems for reducing unwanted sounds in signals received from an arrangement of microphones are disclosed, the method including the steps of: sensing sound sources distributed around a specified target direction by way of an arrangement of microphones to produce left and right microphone output signals; determining the magnitude or power of the left and right microphone signals; attenuating the signals based on the difference of the magnitudes or powers or values derived from the magnitudes or powers of the left and right microphone signals.

18 Claims, 2 Drawing Sheets

(51) Int. Cl.
*G10L 21/034* (2013.01)
*G10L 21/0208* (2013.01)
*G10L 21/0216* (2013.01)
*G10L 21/0232* (2013.01)

(52) U.S. Cl.
CPC ..... *H04R 3/005* (2013.01); *H04R 25/00* (2013.01); *G10L 2021/02166* (2013.01)

(58) Field of Classification Search
USPC ..... 381/317
See application file for complete search history.

(56) References Cited

U.S. PATENT DOCUMENTS 8,290,189 B2 10/2012 Kellermann et al.
8,358,789 B2 1/2013 Fischer et al.
8,774,426 B2 7/2014 Inazumi et al.
2005/0129258 A1* 6/2005 Fincham ..... H04S 1/002 381/160
2008/0260175 A1 10/2008 Elko
2009/0052688 A1* 2/2009 Ishibashi ..... H04R 1/403 381/92
2009/0292536 A1* 11/2009 Hetherington ..... G10L 19/012 704/225
2012/0114142 A1* 5/2012 Nishigori ..... G01V 3/12 381/98
2012/0207325 A1 8/2012 Taenzer

OTHER PUBLICATIONS

European Search Report (EP Appln. No. 14 76 4221); dated: Oct. 12, 2016.
English language abstract for JP 2012-023688 extracted from espacenet.com database on Jun. 25, 2018, 2 pages.

* cited by examiner

NOISE REDUCTION METHOD AND SYSTEM

CROSS REFERENCE TO RELATED APPLICATION

This application is a national stage application of PCT/AU2014/000178, filed Feb. 26, 2014, which claims priority to Australian Patent Application No. 2013900843, filed Mar. 12, 2013, the disclosures of which are hereby incorporated by reference in their entirety.

TECHNICAL FIELD

The present invention relates to a noise reduction method and to systems configured to carry out the method. Embodiments of the invention represent improvements upon, or alternatives to, methods or systems described in applicant's international patent application no PCT/AU2011/001476, published as WO2012/065217, the contents of which are hereby incorporated by reference.

BACKGROUND TO THE INVENTION

In hearing devices, such as hearing aids, background noise is detrimental to the intelligibility of speech sounds. Most modern hearing devices address this issue by introducing noise reduction processing technology into the microphone output signal paths. The aim is to increase the Signal-to-Noise (SNR) ratio available to listeners, hence improve clarity and ease of listening to the hearing device wearer.

The success of noise reduction processing often depends greatly on the formation of appropriate reference signals to estimate the noise, the reason being that the reference signal is used to optimize an adaptive filter that aims to eliminate the noise, ideally leaving only the target signal. However, such reference estimates are often inaccurate because most known techniques, such as Voice Activity Detection, are susceptible to errors. In turn, such inaccuracies lead to inappropriate filtering and degradation in the output quality of processed sound (target distortion), particularly at low SNR where noise reduction functions are most needed.

There remains a need for improved noise reduction methods and systems.

SUMMARY OF THE INVENTION

In a first aspect the present invention a noise reduction method for reducing unwanted sounds in signals received from an arrangement of microphones including the steps of: sensing sound sources distributed around a specified target direction by way of an arrangement of microphones to produce left and right microphone output signals; determining the magnitude or power of the left and right microphone signals; attenuating the signals based on the difference of the magnitudes or powers or values derived from the magnitudes or powers of the left and right microphone signals.

The method may further include the steps of: determining the sum of the magnitudes or powers or values derived from the magnitudes or powers of the left and right microphone signals, wherein the step of attenuating the signals may be further based on a comparison of the difference of the magnitudes or powers or values derived from the magnitudes or powers of the left and right microphone signals with the sum of the magnitudes or powers or values derived from the magnitudes or powers of the left and right microphone signals.

The step of attenuating the signal may be based on the ratio of the difference of the magnitudes or powers or values derived from the magnitudes or powers of the left and right microphone signals to the sum of the magnitudes or powers or values derived from the magnitudes or powers of the left and right microphone signals.

The step of attenuating may be based on one minus the ratio.

The step of attenuating may be based on a transformation of the ratio.

The step of attenuating may be based on one minus the transformation of the ratio.

The difference of the magnitudes or powers or values derived from the magnitudes or powers of the left and right microphone signals may be time-averaged.

The sum of the magnitudes or powers or values derived from the magnitudes or powers of the left and right microphone signals may be time-averaged.

The step of time-averaging may include asymmetric rise and fall times

The step of attenuating may be frequency specific.

The step of attenuating may include determining the attenuation of low frequencies from other frequency bands.

The step of attenuating may include determining the attenuation of selected frequencies based on the magnitude or power of the difference between the left and right microphone signals or a value derived from the magnitude or power of the difference between the left and right microphone signals.

The selected frequencies may be low frequencies.

The attenuation may be scaled by a function.

Unwanted reduction of target output level in high noise levels may be eliminated through an estimator of the amount of noise being eliminated.

An estimator of the amount of noise being eliminated over a frequency range of interest may be derived from the maximum attenuation applied across that range.

In a second aspect the present invention provides a system for reducing unwanted sounds in signals received from an arrangement of microphones including: sensing means for sound sources distributed around a specified target direction by way of an arrangement of microphones to produce left and right microphone output signals; determination means for determining the magnitude or power of the left and right microphone signals; attenuation means for attenuating the signals based on the difference of the magnitudes or powers or values derived from the magnitudes or powers of the left and right microphone signals.

The determination means may be further arranged to determine the sum of the magnitudes or powers or values derived from the magnitudes or powers of the left and right microphone signals; and the attenuation means may be further arranged to attenuate the signals based on a comparison of the difference of the magnitudes or powers or values derived from the magnitudes or powers of the left and right microphone signals with the sum of the magnitudes or powers or values derived from the magnitudes or powers of the left and right microphone signals.

The attenuation means may be arranged to attenuate the signals based on the ratio of the difference of the magnitudes or powers or values derived from the magnitudes or powers of the left and right microphone signals to the sum of the magnitudes or powers or values derived from the magnitudes or powers of the left and right microphone signals.

The attenuation means may be arranged to attenuate the signals based on one minus the ratio.

The attenuation means may be arranged to attenuate the signals based on a transformation of the ratio.

The attenuation means may be arranged to attenuate the signals based on one minus the transformation of the ratio.

In some embodiments, this signal processing technique reduces interference levels in spatially distributed sensor arrays, such as the microphone outputs available in bilateral hearing aids, when the desired target signal arrives from a different direction to those of interfering noise sources. In the field of hearing, this technique can be applied to reduce the effect of noise in devices such as hearing aids, hearing protectors and cochlear implants.

Embodiments of the invention provide an improved and efficient scheme for the removal of noise present in microphone output signals without the need for complex and error-prone estimates of reference signals.

Some embodiments may be used in an acoustic system with at least one microphone located at each side of the head producing microphone output signals, a signal processing path to produce an output signal, and means to present this output signal to the auditory system.

BRIEF DESCRIPTION OF THE DRAWINGS

Embodiments of the present invention will now be described, by way of examples only, with reference to the accompanying drawings, in which.

DETAILED DESCRIPTION OF EMBODIMENTS

The following description of an embodiment is presented for microphone output signals from the left and right sides of the head. The desired sound source to be attended to is presumed to arrive from a specific direction, referred to as the target direction. In the preferred embodiments, multi-band frequency analysis is employed, using for example a Fourier Transform, with left and right channel signals $X_L$ (k) and $X_R$ (k), respectively, where k denotes the $k^{th}$ frequency channel.

Figure 1:
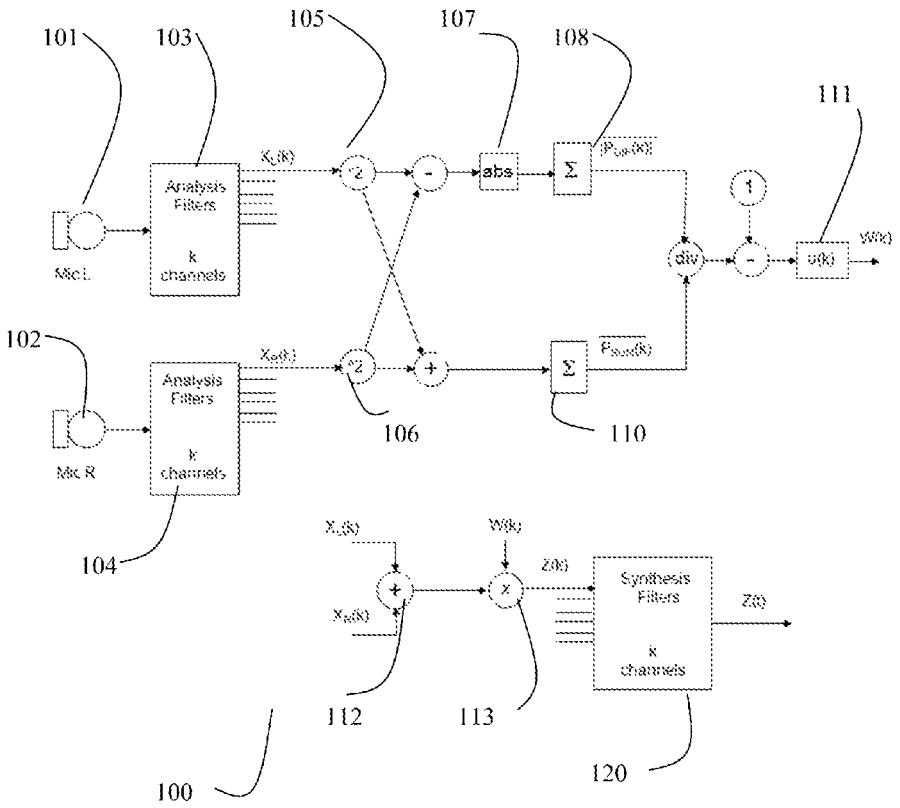
FIG. 1 is a block diagram of a system for conducting a noise reduction method for reducing unwanted sounds in signals received from an arrangement of microphones.

Referring to FIG. 1, a schematic representation of a system 100 according to a preferred embodiment of the invention is shown. The system 100 is embodied in digital signal processing (DSP) hardware and is represented as functional blocks. An overview of the operation of the blocks of system 100 will now be given, and a more detailed explanation of the calculations taking place will follow.

The outputs from detection means in the form of the left 101 and right 102 microphones are transformed into multi-channel signals using an analysis filter bank block, 103 and 104, for example using a Fourier Transform to produce left and right signals $X_L$(k) and $X_R$(k) respectively.

The method then proceeds in the following manner:

1. Measure left and right microphone powers (in each frequency band). Power for each channel in the left and right signals are independently determined by way of determination means 105 and 106.
2. Calculate Ppm, the difference of microphone powers (assumed to contain the difference between L and R ear noise, and little target because that cancels). The absolute value of $P_{DIF}$ is calculated at 107. That is to say, $P_{DIF}$ always has a positive value.
3. Calculate $P_{SUM}$, the sum of difference powers (which contains 2×target and L and R noise components).
4. Time average $P_{DIF}$ and $P_{SUM}$ (optionally with asymmetric rise fall times) by accumulating these values over time using integration processes, 108 and 110, respectively.
5. Calculate "attenuation" u(k) at 111 which equates to $1-(P_{DIF}/P_{SUM})$, which is an estimate of how much the microphone power needs to be scaled back to better approximate the target-only component. Optionally the ratio ($P_{DIF}/P_{SUM}$) may by modified by a scaling function prior to subtracting it from one.
6. Alter the strength of noise reduction by applying a mapping function that translates "attenuation" to arrive at a set of filter weights W(k) In the preferred embodiment the mapping function takes the form of raising "attenuation" to a fixed power, with a default value of 2.6. The value of the fixed power coefficient may be application dependent, user selectable.
7. For low frequencies, there remains the problem that the head provides little attenuation between ears, which leaves much of the noise in that region. To address that problem the very low frequencies are scaled down by an additional factor that is determined from other frequency regions such as a power-weighted average, or alternatively the maximum, of the attenuation applied to the frequencies in the 500-4000 Hz range).

At 112 the left and right signals $X_L$(k) and $X_R$(k) are added together. The filter weights W(k) are applied to the combined signal from block 111 by programmable filter 113 to yield output signal Z(k).

A broadband time-domain signal is optionally created using a synthesis filter bank, 120, for example using an inverse Fourier Transform, and may benefit from further processing such as adjustment of spectral content or time-domain smoothing depending on the application, as will be evident to those skilled in the art.

In the method described above the left and right signals are added together to produce a monaural signal before the channel weight is applied. This provides an additional SNR gain at the expense of the loss of left and right directional cues. An alternative would be to apply the weight to left and right signals separately to retain directional information. Intermediate to those options, in an alternative implementation, ipsilateral and contralateral signals may be weighted unequally before addition to achieve the desired trade off of additive SNR gain and directional cue retention. Such additive weighting may be fixed, or dynamically determined, for example from the channel attenuation.

The following formulae are applied in the method conducted by system 100.

The power in each channel for signals from microphones located on the left and right sides of the head is calculated as follows:

$$P_L(k)=X_L(k)\times^* X_L(k) \quad \text{Eq. 1}$$

$$P_R(k)=X_R(k)\lambda^* X_R(k) \quad \text{Eq. 2}$$

Eq. 1 and Eq. 2 describe the situation for which the target direction corresponds to the direction in which the head is orientated. Optionally the target direction can be altered by filtering the left and right microphone signals. Although the target direction can be specified by the user, it should be obvious to those skilled in the art that an automated process can also be used.

$P_{DIF}$ is calculated as follows:

$$P_{DIF}=|P_R(k)-P_L(k)| \quad \text{Eq. 3}$$

$P_{SUM}$ is calculated as follows:

$$P_{SUM}=P_R(k)+P_L(k) \quad \text{Eq. 4}$$

The time-averaged values of $P_{DIF}$ and $P_{SUM}$ are determined in the preferred embodiment using leaky integration with asymmetric rise ($\tau_r$) and fall ($\tau_f$) times as follows:

$$\text{if } (P_{DIF}(k)<\overline{P}_{DIF}(k))\overline{P}_{DIF}(k)=\overline{P}_{DIF}(k)\lambda(1-\tau_f)+P_{DIF}(k)\times\tau_f$$

else $$\overline{P}_{DIF}(k)=\overline{P}_{DIF}(k)\times(1-\tau_r)+P_{DIF}(k)\times\tau_r \quad \text{Eq. 5}$$

$$\text{if } (P_{SUM}(k)<\overline{P}_{SUM}(k))$$

$$\overline{P}_{SUM}(k)=\overline{P}_{SUM}(k)\times(1-\tau_f)+P_{SUM}(k)\times\tau_f$$

else $$\overline{P}_{SUM}(k)=\overline{P}_{SUM}(k)\times(1-\tau_r)+P_{SUM}(k)\times\tau_r \quad \text{Eq. 6}$$

Alternative time-averaging methods can be used.

The level of attenuation is calculated as follows:

$$u(k)=1-(\overline{P}_{DIFF}/\overline{P}_{SUM}) \quad \text{Eq. 7}$$

Optionally, the ratio ($\overline{P}_{DIFF}/\overline{P}_{SUM}$) is raised to a power prior to subtraction from 1 to modify the shape of the attenuation function. Because u(k) is always less than or equal to 1, attenuation can be increased by raising its value to a power S:

$$w(k)=u(k)^S \quad \text{Eq. 8}$$

Alternative methods to produce the desired strength of noise reduction w(k) from the ratio of ($\overline{P}_{DIFF}/\overline{P}_{SUM}$) may be used. It will be evident to those skilled in the art that there may be benefit from adjusting the noise-reduction strength modifier in a time varying manner, for example according to the output of a signal to noise ratio estimator or algorithms that determine the type of acoustic environment automatically.

The channel weighting values W(k) are applied to the combined channel signals $X_L(k)$ and $X_R(k)$, to produce the channel output signal:

$$Z(k)=W(k)(X_L(k)+X_R(k)) \quad \text{Eq. 9}$$

Alternatively, the desired retention of directional information can be achieved by retaining partial independence of the left and right ear signals to produce a stereophonic output:

$$ZL(k)=W(k)(X_L(k)\times Y_{ipsi}+X_R(k)\times Y_{contra})$$

$$ZR(k)=W(k)(X_L(k)\times Y_{contra}+X_R(k)\times Y_{ipsi}) \quad \text{Eq. 10}$$

Further noise reduction and improved quality of the output signal is derived from an estimator of how much noise is being removed in the frequencies most important to voiced speech intelligibility between 500 Hz and 4 kHz. In the preferred embodiment that estimator is calculated as the largest of the attenuation values applied in the 500-4000 Hz speech range:

$$W_{max}=\max_k(W(k)) \quad \text{Eq. 11}$$

$W_{max}$ is used in the preferred embodiment to determine additional attenuation to be applied to frequency channels below a few hundred Herz, for which the head is an ineffective barrier. In addition it is used to adjust a slow varying AGC that minimises target level reduction that otherwise increases as noise levels increase relative to the target. Alternative metrics to $W_{max}$, such as the power-weighted average of the attenuation applied to the frequency channels in the 500-4000 Hz speech range, may be used in a similar manner.

It will be evident to those skilled in the art that although the example implementation is described in terms of a target direction that is normal to the microphone configuration, i.e. in the "look direction" of a listener wearing a microphone at each ear, the desired target direction can be altered by filtering the left and right ear inputs prior to application of the noise reduction.

In the embodiment described above the power of the microphone signals was determined and then a degree of attenuation in the form of filter weights was calculated based on the power values. Similarly, in other embodiments the magnitude of the signals may be determined. The degree of attenuation may be calculated based on the magnitude values. In other embodiments, the degree of attenuation may be calculated based on values derived from the magnitude or power values.

In a variation to the embodiment described above there may be provided an option to make the attenuation also dependent on phase, rather than amplitude (powers or magnitude) alone. In practice, this new option is used only in low frequency regions where power/magnitude differences between ears can be too small to be effective. In low frequency bands using the new approach, not only are the powers of the left and right signals required, but also the left and right signals need to be subtracted, and the power of their difference (as opposed to the difference of the powers) needs to be calculated.

Figure 2:
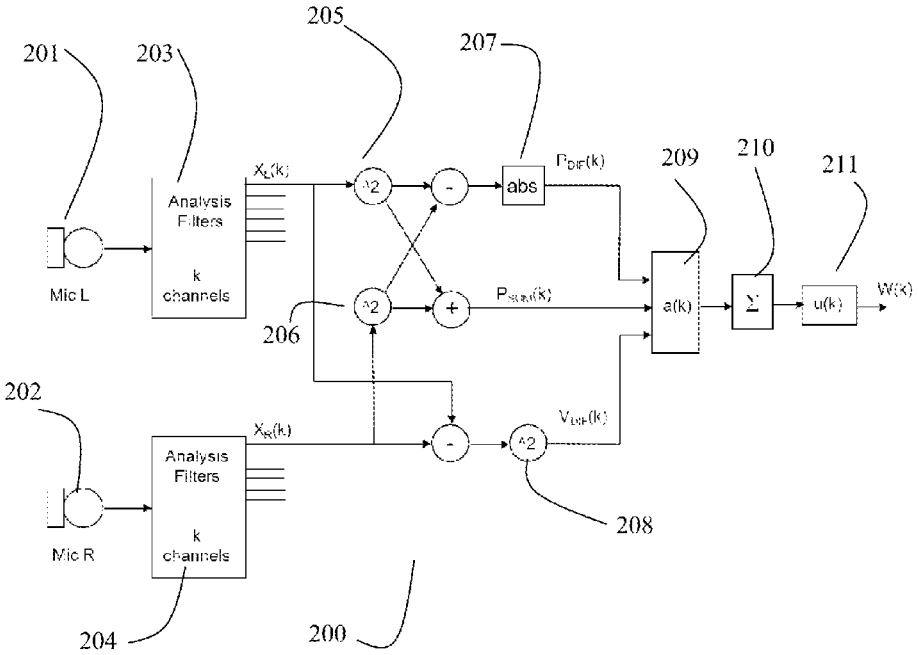
FIG. 2 is a block diagram of a modification of the weight calculation method described in FIG. 1, such that low frequency noise attenuation is improved.

Referring to FIG. 2, a schematic representation of a modified weight calculation system 200 according to a modification of weight calculation described in system 100. The outputs from detection means in the form of the left 201 and right 202 microphones are again transformed into multichannel signals using an analysis filter bank block, 203 and 204, for example using a Fourier Transform to produce left and right signals $X_L(k)$ and $X_R(k)$ respectively.

The method then proceeds in the following manner:

1. As described in steps 1-3 for System 100, calculate the values of $P_{SUM}$, and $P_{DIF}$ from the left and right power values determined by way of power determination means 205 and 206, and absolute value determination means 207.
2. Subtract the left and right signals, $X_L(k)$ and $X_R(k)$, and calculate $V_{DIF}$, the power of the complex vector difference using determination means 208.
3. Calculate the preliminary attenuation a(k) values at 209 using $P_{DIF}$, $P_{SUM}$, and optionally $V_{DIF}$. In the preferred embodiment high frequency bands are processed only using $P_{DIF}$ and $P_{SUM}$ according to: $a(k)=1-(P_{DIF}/P_{SUM})$, and attenuation for low frequency bands incorporates an additional factor dependent on $V_{DIF}$ according to:

$$a(k)=1-(P_{SUM}\times(P_{DIF}+V_{DIF})-(P_{DIF}\times V_{DIF}))/(P_{SUM}*P_{SUM}).$$

4. Optionally alter the strength of the preliminary attenuation to produce the attenuation by applying a mapping function. The mapping function need be neither linear nor time-invariant. In the preferred embodiment, the mapping function is a frequency dependent threshold function that inhibits attenuation above threshold.
5. Time average the attenuation by accumulating its values over time using integration process 208.
6. Optionally alter the strength of the time-averaged attenuation using a further mapping function to produce attenuation values u[k] using for example a power function with a fixed coefficient. The value of the fixed power coefficient is application dependent, and may be user selectable. In the preferred embodiment, the mapping function is unity for low frequency bands that incorporate $V_{DIF}$ dependence, and equal to 2 otherwise.

The introduction of $V_{DIF}$ dependence for low frequencies in system 200 eliminates the need for the additional attenuation factor described in system 100 for very low frequencies. The output weights W[k] determined in system 200 can be used to scale the left and right signals $X_L(k)$ and $X_R(k)$ in the same manner as described for system 100.

The following formulae are applied in the method conducted by system 200:

$P_L(k)$ is calculated according to Eq. 1

$P_R(k)$ is calculated according to Eq. 2

$P_{DIF}$ is calculated according to Eq. 3.

$P_{SUM}$ is calculated according to Eq. 4.

$V_{DIF}$ is the power of the vector difference between left and right signals, calculated as:

$$V_{DIF}=(X_L(k)-X_R(k)\times*(X_L(k)-X_R(K)) \quad \text{Eq. 12}$$

For high frequency bands the preliminary level of attenuation is calculated as follows:

$$a(k)=1(|P_{DIF}|/P_{SUM}) \quad \text{Eq. 13}$$

Note that in contrast to Eq. 7, $P_{DIF}$ and $P_{SUM}$ have not been smoothed

For low frequency bands, the preliminary attenuation is determined according to:

$$a(k)=1-P_{SUM}*(P_{DIF}+V_{DIF})-(P_{DIF}\times V_{DIF}))/(P_{SUM}\times P_{SUM}) \quad \text{Eq. 14}$$

Where $Re(V_{DIF})$ is the real part of the complex power $V_{DIF}$. The time-averaged value of a[k] is determined in the preferred embodiment using frequency-dependent leaky integration as follows:

$$\bar{a}(k)=\bar{a}(k)\times(1-\Sigma_k)+a(k)\times\tau_k \quad \text{Eq. 15}$$

Alternative time-averaging methods can be used.

The time-averaged level of attenuation in the preferred embodiment described in System 200 is further modified by raising a[k] to a fixed frequency-dependent power coefficient as follows:

$$w(k)=\bar{a}(k)^S \quad \text{Eq. 16}$$

Alternative methods to produce the desired strength of noise reduction w(k) may be used.

It will be clear to those skilled in the art that alternative measures that exhibit phase-dependence between left and right signals may be used instead of $V_{DIF}$ to enhance performance in the low frequency bands.

In various embodiments, the boundary between high and low frequencies is dependent upon the particular application. The boundary between high and low frequencies may vary in the range between 500 Hz and 2500 Hz. In the detailed embodiment described above, a value of 1000 Hz may be used.

Any reference to prior art contained herein is not to be taken as an admission that the information is common general knowledge, unless otherwise indicated.

Finally, it is to be appreciated that various alterations or additions may be made to the parts previously described without departing from the spirit or ambit of the present invention.

The invention claimed is:

1. A noise reduction method for reducing unwanted sounds in signals received from an arrangement of microphones including the steps of:

sensing sound sources distributed around a specified target direction by way of an arrangement of microphones to produce left and right microphone output signals including high frequency signals and low frequency signals;

determining the magnitude or power of the left and right microphone signals;

attenuating the signals either i) for both high frequency signals and low frequency signals or ii) for high frequency signals alone, based on the difference of the magnitudes or powers or values derived from the magnitudes or powers of the left and right microphone signals, and additionally attenuating the signals for low frequencies based on the magnitude or power of the difference between the left and right microphone signals or a value derived from the magnitude or power of the difference between the left and right microphone signals.

2. A method according to claim 1 further including the steps of:

determining the sum of the magnitudes or powers or values derived from the magnitudes or powers of the left and right microphone signals, wherein each of the attenuating steps is further based on a comparison of the difference of the magnitudes or powers or values derived from the magnitudes or powers of the left and right microphone signals with the sum of the magnitudes or powers or values derived from the magnitudes or powers of the left and right microphone signals.

3. A method according to claim 2 further comprising the step of time-averaging the sum of the magnitudes or powers or values derived from the magnitudes or powers of the left and right microphone signals.

4. A method according to claim 1 wherein each of the attenuating steps is based on the ratio of the difference of the magnitudes or powers or values derived from the magnitudes or powers of the left and right microphone signals to the sum of the magnitudes or powers or values derived from the magnitudes or powers of the left and right microphone signals.

5. A method according to claim 4 wherein each of the attenuating steps is based on one minus the ratio.

6. A method according to claim 4 wherein each of the attenuating steps is based on a transformation of the ratio.

7. A method according to claim 6 wherein each of the attenuating steps is based on one minus the transformation of the ratio.

8. A method according to claim 1 further comprising the step of time-averaging the difference of the magnitudes or powers or values derived from the magnitudes or powers of the left and right microphone signals.

9. A method according to claim 8 wherein the step of time-averaging includes time-averaging utilizing asymmetric rise and fall times.

10. A method to claim 1 wherein the attenuated signals are scaled by a function.

11. A method to claim 1 further comprising eliminating unwanted reduction of target output level in high noise levels through an estimator of the amount of noise being eliminated.

12. A method according to claim 11 wherein the estimator of the amount of noise being eliminated over a frequency range of interest is derived from the maximum attenuation applied across that range.

13. A system for reducing unwanted sounds in signals received from an arrangement of microphones including:

sensing means for sound sources distributed around a specified target direction by way of an arrangement of microphones to produce left and right microphone output signals including high frequency signals and low frequency signals;

determination means for determining the magnitude or power of the left and right microphone signals;

first attenuation means for attenuating either i) high frequency signals and low frequency signals or ii) high frequency signals alone, based on the difference of the magnitudes or powers or values derived from the magnitudes or powers of the left and right microphone signals; and second attenuation means for additionally attenuating the low frequency signals based on the magnitude or power of the difference between the left and right microphone signals or a value derived from the magnitude or power of the difference between the left and right microphone signals.

14. A system according to claim 13 wherein the determination means is further arranged to determine the sum of the magnitudes or powers or values derived from the magnitudes or powers of the left and right microphone signals; and each of the first and second attenuation means is further arranged to attenuate the signals based on a comparison of the difference of the magnitudes or powers or values derived from the magnitudes or powers of the left and right microphone signals with the sum of the magnitudes or powers or values derived from the magnitudes or powers of the left and right microphone signals.

15. A system according to claim 13 wherein each of the first and second attenuation means is arranged to attenuate the signals based on the ratio of the difference of the magnitudes or powers or values derived from the magnitudes or powers of the left and right microphone signals to the sum of the magnitudes or powers or values derived from the magnitudes or powers of the left and right microphone signals.

16. A system according to claim 15 wherein each of the first and second attenuation means is arranged to attenuate the signals based on one minus the ratio.

17. A system according to claim 15 wherein each of the first and second attenuation means is arranged to attenuate the signals based on a transformation of the ratio.

18. A system according to claim 17 wherein each of the first and second attenuation means is arranged to attenuate the signals based on one minus the transformation of the ratio.

* * * * *